United States Patent [19]

Horn et al.

[11] Patent Number: 4,648,113

[45] Date of Patent: Mar. 3, 1987

[54] METHOD AND APPARATUS FOR PROVIDING A VISUAL INDICATION OF A RELATIONSHIP BETWEEN TWO SIGNALS

[75] Inventors: John J. Horn, Hillsboro; Daniel G. Baker, Beaverton, both of Oreg.

[73] Assignee: Tektronix, Inc., Beaverton, Oreg.

[21] Appl. No.: 774,781

[22] Filed: Sep. 11, 1985

[51] Int. Cl.[4] ..... H04R 5/00

[52] U.S. Cl. ..... 381/1; 358/10; 358/81; 358/82; 84/464 R; 324/88

[58] Field of Search ..... 358/10, 81, 82; 84/464 R; 324/77 E, 83 Q, 88; 381/1, 2, 3, 4, 97; 340/722, 754

[56] References Cited

U.S. PATENT DOCUMENTS

| | | | |
|---|---|---|---|
| 2,500,646 | 3/1950 | Riesz | 324/77 E |
| 2,986,700 | 5/1961 | Diehl | 324/83 Q |
| 3,039,054 | 6/1962 | Hadley | 324/88 |
| 3,627,912 | 12/1971 | Hearn | 358/82 |
| 3,665,471 | 5/1972 | Laval | 324/88 |
| 3,806,648 | 4/1974 | Odagi | 381/19 |
| 3,856,985 | 12/1974 | Yokoi et al. | 358/81 |
| 3,876,936 | 4/1975 | Lester et al. | 324/88 |
| 3,940,789 | 2/1976 | Kratz et al. | 358/82 |
| 3,969,972 | 7/1976 | Bryant | 358/81 |
| 4,081,829 | 3/1978 | Brown | 358/82 |
| 4,128,846 | 12/1978 | Robinson, Jr. | 358/82 |
| 4,135,203 | 1/1979 | Friedman | 358/81 |
| 4,167,752 | 9/1979 | Liebler et al. | 358/82 |
| 4,195,310 | 3/1980 | Anello | 358/81 |
| 4,237,482 | 12/1980 | Brentlinger | 358/81 |
| 4,257,062 | 3/1981 | Meredith | 358/81 |
| 4,267,561 | 5/1981 | Karpinsky et al. | 358/82 |

*Primary Examiner*—Forester W. Isen

*Attorney, Agent, or Firm*—John Smith-Hill; Francis I. Gray

[57] ABSTRACT

A visual indication of the relationship between first and second electrical signals, such as the left and right channel signals in a stereophonic audio system, is provided through use of a video vectorscope. The first and second signals are used to modulate the amplitude of two sinusoidal waves at a subcarrier frequency and in phase quadrature, so as to synthesize the chrominance portion of a composite video signal. The two modulated sine waves are additively combined, and the resulting signal is applied to the input terminal of the vectorscope.

7 Claims, 1 Drawing Figure

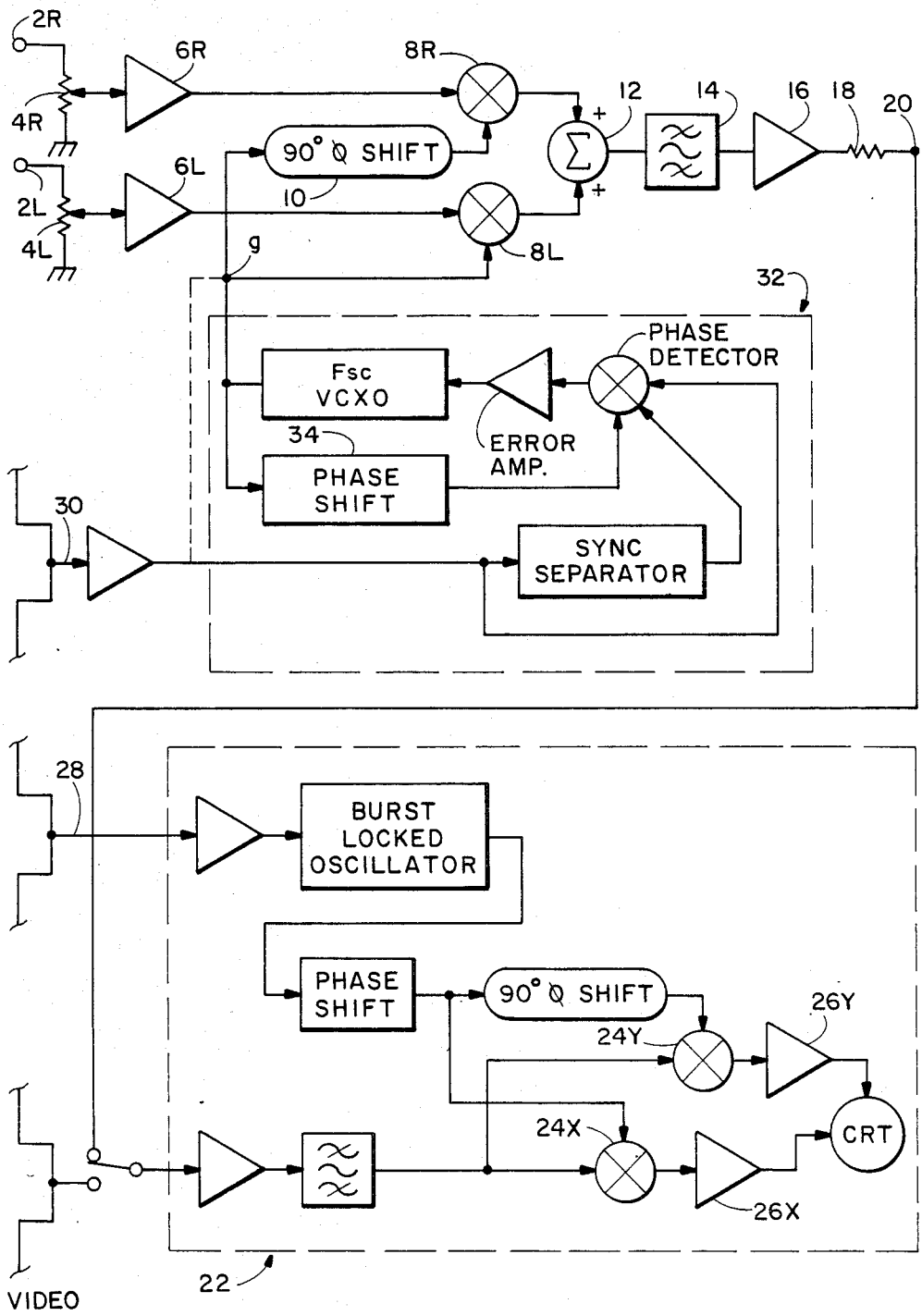
2R
4R
6R
8R
12
14
16
18
20
90° Q SHIFT
10
2L
4L
6L
8L
g
32
PHASE DETECTOR
Fsc VCXO
ERROR AMP.
34
PHASE SHIFT
30
SYNC SEPARATOR
28
BURST LOCKED OSCILLATOR
PHASE SHIFT
90° Q SHIFT
26Y
24Y
24X
CRT
26X
VIDEO
22

METHOD AND APPARATUS FOR PROVIDING A VISUAL INDICATION OF A RELATIONSHIP BETWEEN TWO SIGNALS

This invention relates to a method and apparatus for providing a visual indication of a relationship between two signals.

BACKGROUND OF THE INVENTION

The video vectorscope is an instrument that is widely used for evaluation of a composite color television signal. As used in this description and in the appended claims, the term "vectorscope" means an instrument having an input terminal, a display surface, means for generating a visible dot on the display surface, X and Y deflection means for deflecting the position of the visible dot in mutually perpendicular rectilinear directions, a wave regenerator for generating a continuous wave signal at a predetermined operating frequency, first and second demodulators having their outputs connected to the X and Y deflection means respectively and each having first and second inputs, means connecting the output of the wave regenerator to the first inputs of the first and second demodulators with a quarter-period relative phase difference, and a filter which passes signal components at the operating frequency of the wave regenerator and is connected between the input terminal of the vectorscope and the second inputs of the first and second demodulators. The term "video vectorscope" means a vectorscope in which the operating frequency is the color subcarrier frequency.

A composite color video signal contains timing information and information representative of the distribution of color over a scene. The scene may be a natural scene, imaged on the image-receiving surface of a video camera, or it may be an artificial scene, such as might be created using a video graphics unit or a test signal generator. In any event the signal, when used to drive a video display unit, causes the video display unit to create an image that conveys intelligible information through the visual sense. As used in this description and in the appended claims, a signal is "representative of a variable other than the distribution of color over a scene" if, when used to drive a video display unit, it does not cause the display unit to create an image that conveys intelligible information through the visual sense. An image conveys intelligible information through the visual sense if it contains not only information representative of color difference but also information representative of perceptible structure.

It is common for a videotape recorder (VTR) to include a video vectorscope in its instrument bridge. The vectorscope is used to determine whether the color information of a composite color television signal being processed by the VTR is properly encoded, so that upon playback the color information can be recovered using a standard display.

A VTR is used to record not only visual information but also audio information. Frequently, an audio signal is transmitted about a television studio in balanced form using a two-conductor cable. With a monaural audio system, the relative polarities of the two conductors that carry the balanced audio signal are unimportant. Consequently, in the case of a monaural audio system it is not necessary to pay attention to the polarities of the two conductors, and many of the connectors used for connecting the two-conductor cables are not polarized.

With the increasing use of stereophonic audio systems in television studios, it has become necessary to distinguish the polarities of the conductors, of a two-conductor audio cable, because if the left audio signal is out of phase with the right audio signal, when the signals are combined to produce L+R and L−R components information that should be added will be subtracted and vice-versa. It is therefore necessary to provide an instrument that will enable a determination to be made easily regarding whether the two balanced cables of a stereophonic audio system are connected with the proper polarities.

An X-Y oscilloscope may be used to determine whether two periodic signals are in phase, by connecting the two signals to the two deflection amplifiers respectively and observing the shape of the display that is obtained. If the two signals are pure sine waves, the display will be a Lissajous figure, and its shape will depend on the phase and frequency relationships between the two signals. If the signals are the same frequency, the Lissajous figure will be an ellipse having a major axis extending diagonally across the screen of the CRT from its lower left corner to its upper right corner if the signals are in phase. If the signals are out of phase, the major axis of the ellipse will be disposed along the other diagonal of the CRT screen. It has been proposed that this type of display be used to determine whether the cables of a stereophonic audio system are connected to a VTR with the proper polarity. However, the space available on the instrument bridge of a VTR is severely restricted, and addition to the bridge of an instrument to check the polarities of the audio connections to the VTR may necessitate removal of some other instrument.

SUMMARY OF THE INVENTION

In a preferred embodiment of the invention, a visual indication of the relationship between first and second electrical signals, such as the left and right channel signals in a stereophonic audio system, is provided through use of a video vectorscope. The first and second signals are used to modulate the amplitude of two sinusoidal waves at subcarrier frequency and in phase quadrature, so as to synthesize the chrominance portion of a composite video signal. The two modulated sine waves are additively combined, and the resulting signal is applied to the input terminal of the vectorscope.

BRIEF DESCRIPTION OF THE DRAWINGS

For a better understanding of the invention, and to show how the same may be carried into effect, reference will now be made, by way of example, to the accompanying drawings, the single figure of which is a block diagram of apparatus connected to a video vectorscope for enabling the vectorscope to be used to examine the phase relationship between right and left audio channels of a stereophonic sound system for television.

Detailed Description

The apparatus illustrated in the figure comprises two input terminals 2L and 2R that are connected to receive left and right channel singleended audio signals. Typically, each terminal would receive its audio signal from a two-conductor audio cable by way of a differential amplifier which converts the balanced audio signals on the two-conductor cable to a single-ended form. The two terminals 2L and 2R are connected through potentiometers 4L and 4R to respective amplifiers 6L and 6R. The amplifiers 6L and 6R serve to buffer the input terminals and limit the maximum bandwidth of the signals to a maximum frequency of 1-2 MHz to protect the modulation process which follows. The outputs of the amplifiers 6L, 6R are connected to respective two double-balanced mixers 8L, 8R. Each mixer has a second input terminal at which it receives a signal at subcarrier frequency (3.58 MHz in the case of the NTSC system). The two signals at subcarrier frequency are in phase quadrature by virtue of their originating from a common terminal 9 and there being a 90 degree phase shifter 10 connected between the terminal 9 and the mixer 8R.

The outputs of the two mixers 8L and 8R are combined in a summer 12, and the output of the summer is connected to a bandpass filter 14 having a center frequency at subcarrier frequency and having a bandwidth of about 2 MHz. The output of the filter 14 is connected through a video amplifier 16 and a 75 impedance matching resistor 18 to an output terminal 20.

In order to determine whether the left and right audio channels are connected in phase to the terminals 2L and 2R, the output terminal 20 is connected to the A/B signal input of a conventional vectorscope 22. It will be appreciated by those skilled in the art that the demodulators 24 of the vectorscope will separate the left and right channel audio signals and apply them to the Y and X deflection amplifiers 26Y and 26X respectively, and accordingly the vectorscope will provide a display of the relative magnitudes of the left and right channel audio signals. Since the typical vectorscope has a bandwidth of up to about 600 kHz, the display yields information regarding the instantaneous relative magnitudes of the left and right channel signals, and not just the long term relative magnitudes, as would be provided by VU meters. Therefore, it is possible to make deductions from the display regarding the relative phase of the audio signals. Since, in a stereophonic audio system, most of the energy in the left and right channels is attributable to common information and only a small proportion of the energy is attributable to difference information, with typical stereophonic signals the display on the screen of the vectorscope is a relatively narrow illuminated band. If the subcarrier frequency signal used to generate the signal applied to the input terminal of the vectorscope is in phase with the subcarrier frequency signal against which the signal is demodulated, the band is oriented along the diagonal from the lower left corner of the vectorscope screen to its upper right corner if the left and right audio signals are in phase and is oriented along the other diagonal if the left and right audio signals are out of phase.

It will therefore be seen that the present invention provides the advantage of being able to provide an X - Y display of two signals using a vectorscope, which has only one signal input terminal.

The subcarrier frequency signal that is applied to the mixers 8 may be a continuous wave subcarrier from a master subcarrier generator, or it may be a regenerateed CW signal locked to a black burst composite video signal. The subcarrier frequency signal is applied to the reference input 28 of the vectorscope and to a terminal 30 which is connected to the terminal 9 either directly or through a subcarrier regenerator 32. The subcarrier regenerator is of conventional form and provides at the terminal 9 a continuous wave signal at subcarrier frequency and adjustable in phase relative to the signal applied to the terminal 30. The phase shifter 34 of the subcarrier regenerator makes it possible to cancel the effects of differential time delays in the cables between the vectorscope 22 and the terminals 20 and 30. Moreover, the phase shifter 34 makes it possible, at a given setting of the phase shifter of the vectorscope, to properly orient the display provided by the signal at the terminal 20 so as to not require readjustment of the phase shifter of the vector- scope.

It will be appreciated that the present invention is not restricted to the particular method and apparatus that have been described, and that variations may be made therein without departing from the scope of the invention as defined in the appended claims, and equivalents thereof. For example, although the invention has been described in terms of determining the phase relationship between two audio signals, the same technique may be used to determine or monitor other relationships between other variables, by using signals representative of those variables to modulate signals of constant frequency but in phase quadrature in order to synthesize the chrominance portion of a composite video signal.

We claim:

1. A method of providing a visual indication of a relationship between first and second electrical signals that are representative of variables other than the distribution of color over a scene, comprising the steps of using the first and second signals to modulate the amplitude of first and second sinusoidal waves at the operating frequency of the wave regenerator of a vectorscope, said first and second waves being in phase quadrature, additively combining said two modulated waves, and applying the resulting wave to the signal input terminal of the vectorscope.

2. A method according to claim 1, wherein the first and second electrical signals are audio frequency signals representative of sound levels detected at two spaced apart locations on a sound stage.

3. A method according to claim 1, comprising the steps of applying a sinusoidal wave at said operating frequency to a terminal, modulating the signal applied to said terminal using said first signal, shifting the phase of the signal applied to said terminal through one quarter of the period of said operating frequency, and modulating the phase-shifted signal using said second signal.

4. A method according to claim 1, wherein the vectorscope has a reference input terminal which is connected to the wave regenerator and receives a signal at said operating frequency, and the wave regenerator generates a continuous wave signal in predetermined phase relationship to the signal applied to the reference terminal, and the method also comprises using the signal applied to the reference terminal of the vectorscope to generate said first and second sinusoidal waves.

5. In combination, a vectorscope having a wave regenerator operating at a frequency to provide a visual indication of a relationship between first and second electrical signals that are representative of variables other than the distribution of color over a scene, mixer means for using the first and second signals to modulate the amplitude of first and second sinusoidal waves at said operating frequency of said wave regenerator of said vectorscope, said first and second waves being in phase quadrature, and means for additively combining the two modulated waves.

6. Apparatus according to claim 5, comprising first and second transducers for converting energy other than optical energy into electrical energy to provide said first and second electrical signals.

7. Apparatus according to claim 6, wherein said transducers are acousto-electric transducers.

* * * * *